US007561112B2

(12) United States Patent
Sako

(10) Patent No.: US 7,561,112 B2
(45) Date of Patent: Jul. 14, 2009

(54) COMPOSITE ANTENNA DEVICE

(75) Inventor: Motohiko Sako, Osaka (JP)

(73) Assignee: Panasonic Corporation, Osaka (JP)

( * ) Notice: Subject to any disclaimer, the term of this patent is extended or adjusted under 35 U.S.C. 154(b) by 98 days.

(21) Appl. No.: 10/574,596

(22) PCT Filed: Jul. 28, 2005

(86) PCT No.: PCT/JP2005/014243

§ 371 (c)(1),
(2), (4) Date: Apr. 5, 2006

(87) PCT Pub. No.: WO2006/011659

PCT Pub. Date: Feb. 2, 2006

(65) Prior Publication Data

US 2007/0024513 A1 Feb. 1, 2007

(30) Foreign Application Priority Data

Jul. 29, 2004 (JP) ..... 2004-221330

(51) Int. Cl.
*H01Q 21/00* (2006.01)
*H01Q 1/00* (2006.01)
*H01Q 1/24* (2006.01)

(52) U.S. Cl. ..... 343/727; 343/730; 343/702

(58) Field of Classification Search ..... 343/727, 343/730, 702, 725, 726, 729, 700 MS, 793, 343/749, 751, 752
See application file for complete search history.

(56) References Cited

U.S. PATENT DOCUMENTS 5,300,936 A * 4/1994 Izadian ..... 343/700 MS
6,788,265 B2 * 9/2004 Kuramoto ..... 343/752
2002/0033774 A1 * 3/2002 Ha et al. ..... 343/702
2003/0189519 A1 * 10/2003 Rutfors et al. ..... 343/702
2005/0162321 A1 * 7/2005 Colburn et al. ..... 343/702

FOREIGN PATENT DOCUMENTS

JP 2001-251117 A 9/2001
JP 2003-298340 A 10/2003
JP 2004-023369 A 1/2004

OTHER PUBLICATIONS

International Search Report for PCT/JP2005/014243, dated Nov. 22, 2005.

* cited by examiner

*Primary Examiner*—Hoang V Nguyen
*Assistant Examiner*—Robert Karacsony
(74) *Attorney, Agent, or Firm*—RatnerPrestia

(57) ABSTRACT

A composite antenna device includes a ground board, an unbalanced antenna, a balanced antenna. The unbalanced antenna includes a first feeding point coupled with the ground board, a first radiator having a second end and a first end connected with the first feeding point, and a load conductor connected with the second end. The balanced antenna includes a second feeding point, a second radiator connected with the second feeding point, and a third radiator connected with the second feeding point. The load conductor has a shape symmetrical about a straight line which passes through the first feeding point and which is perpendicular to the ground board. The second radiator and the third radiator are placed at positions symmetrical to each other about the straight line, respectively, and have shapes symmetrical to each other about the straight line. The composite antenna has a large isolation between the unbalanced antenna and the balanced antenna, accordingly having a small size.

3 Claims, 5 Drawing Sheets

COMPOSITE ANTENNA DEVICE

This application is a U.S. National Phase application of PCT International application PCT/JP2005/014243.

TECHNICAL FIELD

The present invention relates to a composite antenna device including plural antennas for use in radio communication apparatuses.

BACKGROUND OF THE INVENTION

In composite antenna devices, such as a diversity antenna including plural antennas disclosed in Japanese Patent Laid-Open Publication No.2003-298340, isolation between the antennas generally needs to be large. A space between the antennas is set to be large as to increase the isolation between the antennas.

Mobile communication apparatuses, such as a mobile telephone, have been desired to have small sizes. A composite antenna device used in the communication apparatuses hardly has a large space between antennas of the composite antenna device, accordingly having a small isolation between the antennas.

SUMMARY OF THE INVENTION

A composite antenna device includes a ground board, an unbalanced antenna, a balanced antenna. The unbalanced antenna includes a first feeding point coupled with the ground board, a first radiator having a second end and a first end connected with the first feeding point, and a load conductor connected with the second end. The balanced antenna includes a second feeding point, a second radiator connected with the second feeding point, and a third radiator connected with the second feeding point. The load conductor has a shape symmetrical about a straight line which passes through the first feeding point and which is perpendicular to the ground board. The second radiator and the third radiator are placed at positions symmetrical to each other about the straight line, respectively, and have shapes symmetrical to each other about the straight line.

The composite antenna has a large isolation between the unbalanced antenna and the balanced antenna, accordingly having a small size.

DETAILED DESCRIPTION OF THE PREFERRED EMBODIMENTS

Exemplary Embodiment 1

Figure 1:
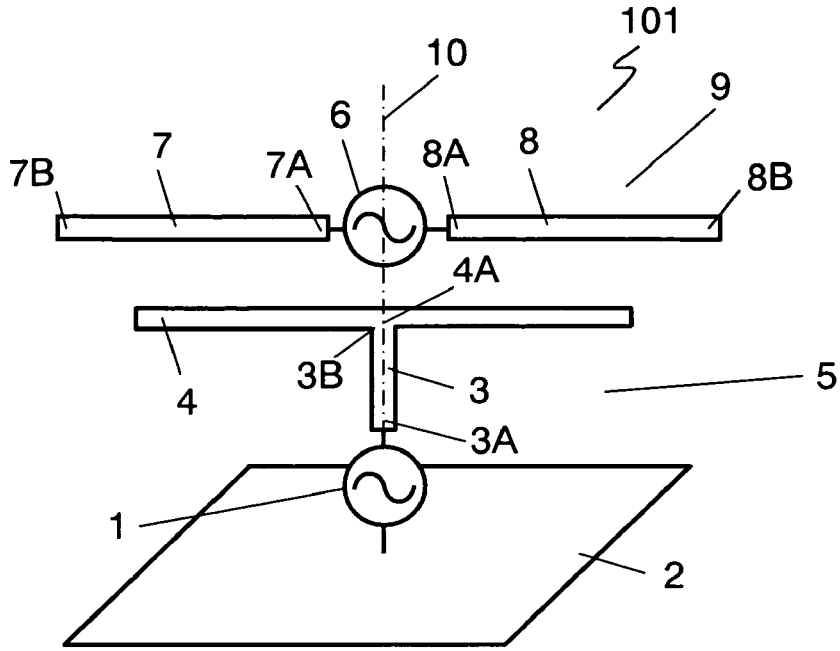
FIG. 1 is a schematic perspective view of a composite antenna device according to Exemplary Embodiment 1 of the present invention.

FIG. 1 is a schematic perspective view of composite antenna device 101 in accordance with Exemplary Embodiment 1 of the present invention. Composite antenna device 101 includes unbalanced antenna 5 and balanced antenna 9. End 3A of radiator 3 having a bar shape is connected with feeding point 1, and is coupled with ground board 2 via feeding point 1. Feeding point 1 is coupled with ground board 2. End 3B of radiator 3 opposite to end 3A is connected with connection point 4A of load conductor 4 having a bar shape. Radiator 3 and load conductor 4 provide unbalanced antenna 5. Ends 7A and 8A of radiators 7 and 8 having bar shapes are connected with feeding point 6, and provide balanced antenna 9. Load conductor 4 has end 4B and end 4C opposite to end 4B.

Load conductor 4 of unbalanced antenna 5 has a shape symmetrical about straight line 10. Line 10 passes through feeding point 1 and is perpendicular to ground board 2. Radiators 7 and 8 of balanced antenna 9 are placed at positions symmetrical to each other about straight line 10, and have shapes symmetrical to each other about straight line 10.

An operation of composite antenna device 101 will be described below.

Figure 2:
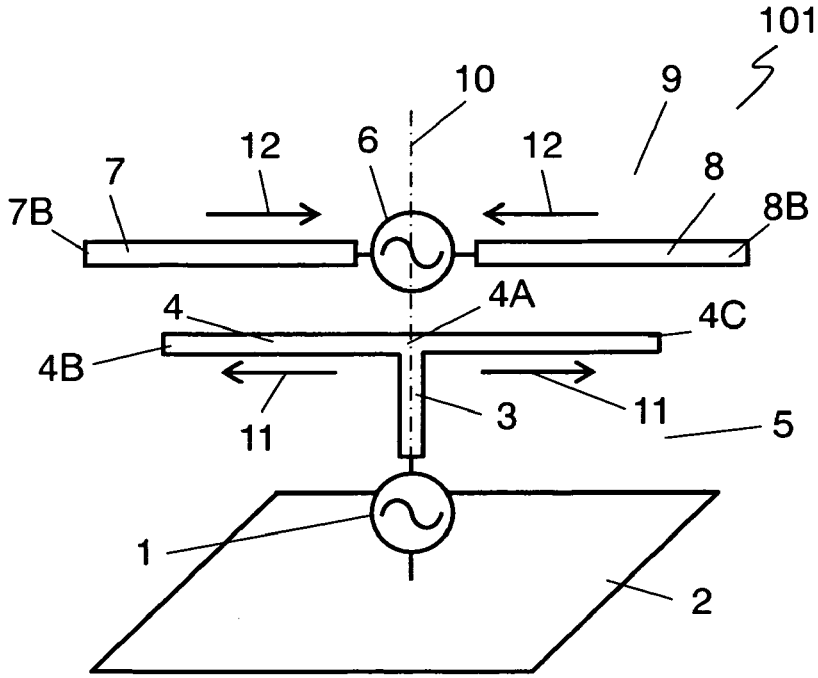
FIG. 2 is a schematic perspective view of the composite antenna device operating according to Embodiment 1.

FIG. 2 is a schematic perspective view of unbalanced antenna 5 of composite antenna device 101 being used. A current flows from feeding point 1 to load conductor 4 via radiator 3 in direction 11 which is directed towards ends 4B and 4C from connection point 4A connected with radiator 3. A current excited at radiators 7 and 8 of balanced antenna 9 by the current flowing in load conductor 4 flows in direction 12 which is directed towards feeding point 6 from respective ends 7B and 8B of radiators 7 and 8. Since radiators 7 and 8 are symmetrical each other about straight line 10, a potential difference between radiators 7 and 8 at feeding point 6 is zero. Accordingly, while unbalanced antenna 5 is used, unbalanced antenna 5 does not affect balanced antenna 9 apparently. Thus, while unbalanced antenna 5 operates, this antenna device provides a large isolation of unbalanced antenna 5 to balanced antenna 9.

Figure 3:
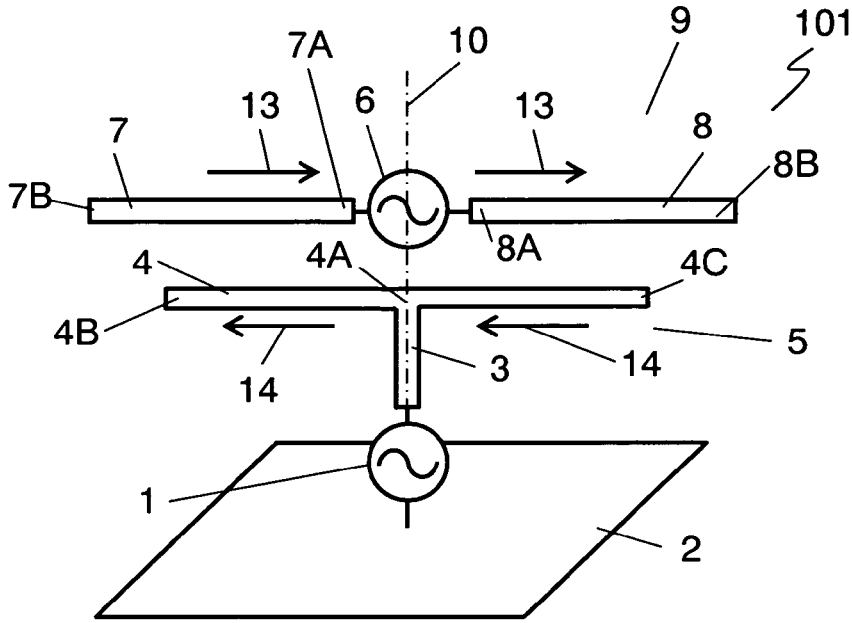
FIG. 3 is a schematic perspective view of the composite antenna device operating according to Embodiment 1.

FIG. 3 is a schematic perspective view of balanced antenna 9 of composite antenna device 101 operating. When balanced antenna 9 operates, a current flows in direction 13 directed from end 7B of radiator 7 to end 8 of 8B via end 7A, feeding point 6, and end 8A of radiator 8. A current is induced in load conductor 4 of unbalanced antenna 5 by the current flowing in radiators 7 and 8. The induced current flows in direction 14 directed from end 4B to end 4C of load conductor 4, that is, in a direction opposite to the direction of the current flowing in balanced antenna 9. Since load conductor 4 has a shape symmetrical about straight line 10, a voltage at connection point 4A connected with radiator 3 of load conductor 4 is always zero. This situation prevents balanced antenna 9 from affecting unbalanced antenna 5 while balanced antenna 9 operates. Thus, balanced antenna 9 is isolated much from unbalanced antenna 5 while the operation of balanced antenna 9.

As discussed above, composite antenna device 101 reduces a change in potentials at feeding points 1 and 6 which is caused by mutual interference between antenna 5 and antenna 9. The antenna device accordingly has a large isolation between antenna 5 and antenna 9, accordingly having a small size.

Exemplary Embodiment 2

Figure 4:
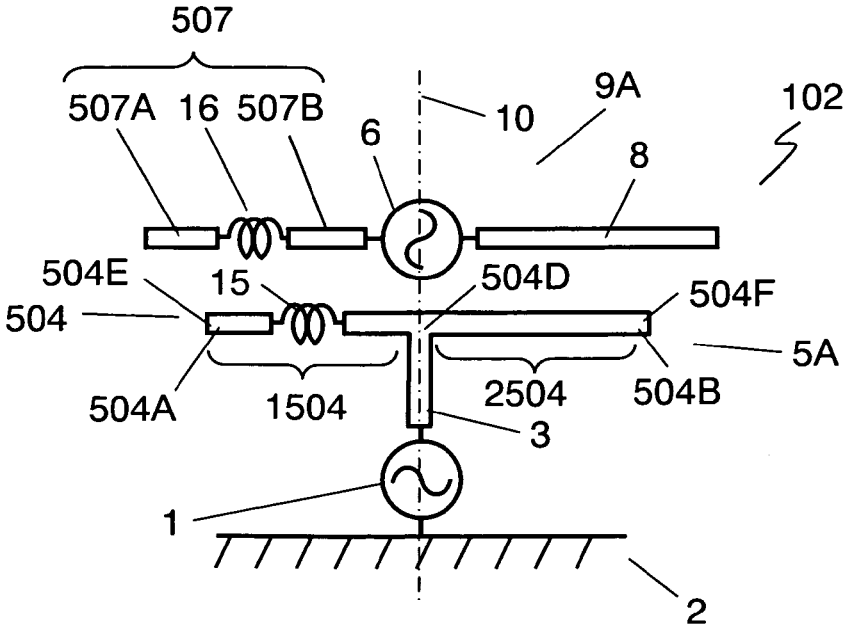
FIG. 4 is a side view of a composite antenna device according to Exemplary Embodiment 2 of the invention.

FIG. 4 is a side view of composite antenna device 102 in accordance with Exemplary Embodiment 2 of the present invention. In FIG. 4, Elements similar to those of Embodiment 1 shown in FIG. 1 are denoted by the same reference numerals, and their description will be omitted. Composite antenna device 102 includes unbalanced antenna 5A and balanced antenna 9A instead of unbalanced antenna 5 and balanced antenna 9 of composite antenna device 101 shown in FIG. 1. Unbalanced antenna 5A includes load conductor 504 instead of load conductor 4 shown in FIG. 1. Load conductor 504 includes conductor 504A having a stick shape, conductor 504B having a stick shape, and inductor 15 for connecting conductor 504A with conductor 504B. Balanced antenna 9A includes radiator 507 instead of radiator 7 shown in FIG. 1. Radiator 507 includes conductor 507A having a stick shape, conductor 507B having a stick shape, and inductor 16 for connecting conductor 507A with conductor 507B. Radiator 507 is shorter than radiator 8. Load conductor 504 is connected with radiator 3 at connection point 504D. Portion 1504 of load conductor 504A including inductor 15 from connection point 504D is shorter than portion 2504 of load conductor 504A opposite to portion 1502, that is, portion 1502 which does not include inductor 15 from connection point 504D.

Respective inductances of inductors 15 and 16 are adjusted so that load conductor 504 may be electrically symmetrical about straight line 10 which passes through feeding point 1 and which is perpendicular to ground board 2. Load conductor 504 has both ends 504E and 504F, and connected with end 3B of radiator 3 at connection point 504D. Load conductor 504 includes portion 1504 and portion 2504. Portion 1504 is provided between connection point 504D and end 504E. Portion 2504 is provided between connection point 504D and end 504F.

The inductance of inductor 16 is adjusted so that radiators 507 and 8 may be placed at positions electrically symmetrical to each other about straight line 10. Respective inductances of inductors 15 and 16 are adjusted so that radiators 507 and 8 have shapes electrically symmetrical to each other about straight line 10.

Although not being geometrically symmetrical, composite antenna device 102 allows unbalanced antenna 5A to be electrically symmetrical about straight line 10 and allows balanced antenna 9A to be electrically symmetrical about straight line 10. Therefore, voltages at feeding points 1 and 6 are identical to those of composite antenna device 101 of Embodiment 1. This reduces a change of potentials at feeding points 1 and 6 which is caused by mutual interference between antenna 5A and antenna 9A in composite antenna device 102. Composite antenna 102 accordingly has a large isolation between antenna 5A and antenna 9A, accordingly having a small size.

Figure 5:
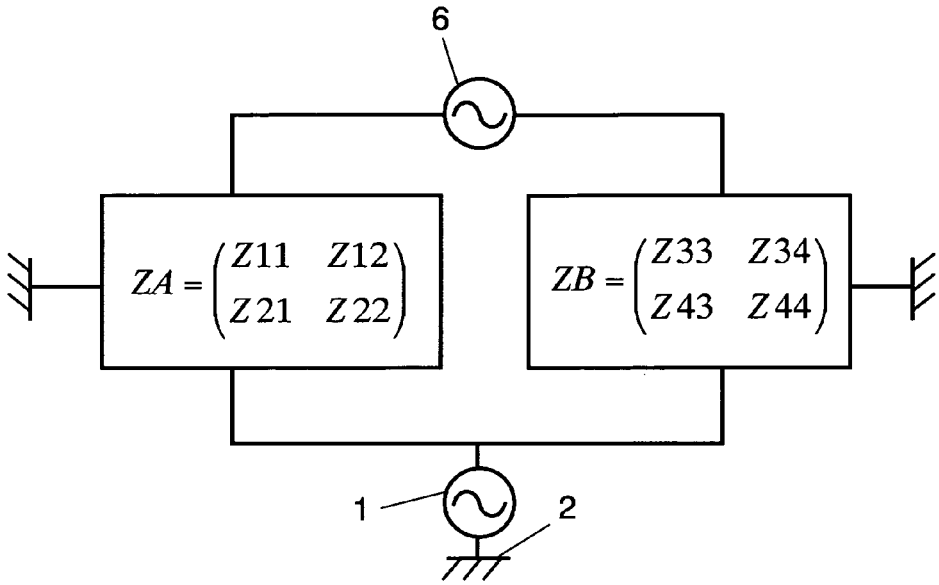
FIG. 5 is a circuit diagram of the composite antenna device according to Embodiment 2.

FIG. 5 is a circuit diagram of composite antenna device 102. According to FIG. 5, the relationship between respective impedances of portion 1504 of load conductor 504 and radiator 507, and the relationship between respective impedances of portion 2504 of load conductor 504 and radiator 8 will be discussed below. Z11 represents an impedance of portion 1504 of load conductor 504. Z12 represents a mutual impedance of radiator 507 to portion 1504. Z21 represents a mutual impedance of portion 1504 of load conductor 504 to radiator 507. Z22 represents an impedance of radiator 507. Z33 represents an impedance of portion 2504 of load conductor 504. Z34 represents a mutual impedance of radiator 8 to portion 2504 of load conductor 504. Z43 represents a mutual impedance of portion 2504 of load conductor 504 to radiator 8. Z44 represents an impedance of radiator 8. Impedance matrixes ZA and ZB are defined as follows:

$$ZA = \begin{pmatrix} Z11 & Z12 \\ Z21 & Z22 \end{pmatrix}$$

$$ZB = \begin{pmatrix} Z33 & Z34 \\ Z43 & Z44 \end{pmatrix}$$

Impedance matrixes ZA and ZB satisfy the relation of ZA=ZB.

Figure 6:
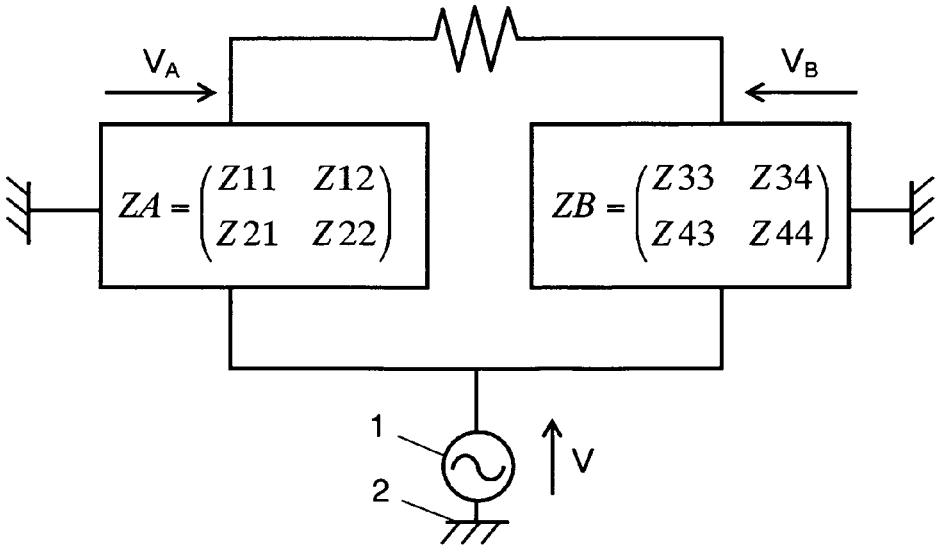
FIG. 6 is a circuit diagram of the composite antenna device operating according to Embodiment 2.

FIG. 6 is a circuit diagram of unbalanced antenna 5A of composite antenna device 102 operating. A voltage (V), upon being applied to unbalanced antenna 5A at feeding point 1, induces voltage (VA) at radiator 507, and induces voltage (VB) at radiator 8. The relation of ZA=ZB provides the relation of VA=VB, thus preventing a voltage from being induced between radiator 507 and radiator 8. Accordingly, a current does not flow at feeding point 6 of balanced antenna 9A, so that balanced antenna 9A is isolated much from unbalanced antenna 5A.

Figure 7:
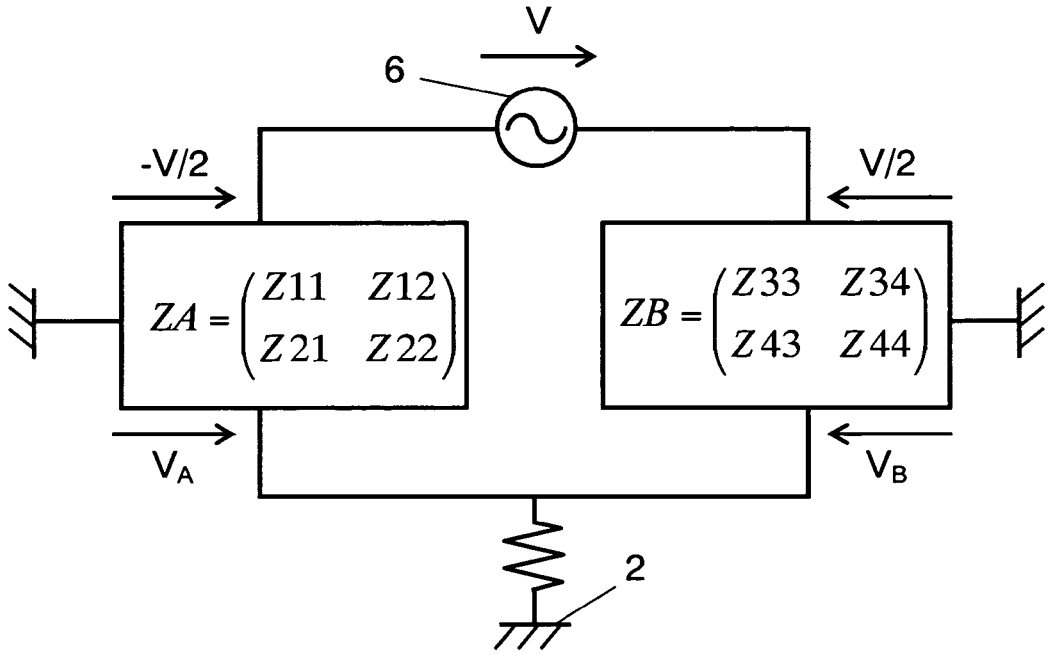
FIG. 7 is a circuit diagram of the composite antenna device operating according to Embodiment 2.

FIG. 7 is a circuit diagram of balanced antenna 9A of composite antenna device 102 operating. A voltage (V), upon being applied to balanced antenna 9A at feeding point 6, provides voltage (−V/2) applied between feeding point 6 and radiator 7A, and provides voltage (V/2) applied between feeding point 6 and radiator 8. Voltage (V/2) and voltage (−V/2) induces voltage (VA) at portion 1504 of load conductor 504, and induces voltage (VB) at portion 2504. The relation of ZA=ZB provides the relation of −VA=VB, thus causing a voltage between portion 1504 and portion 2504 of load conductor 504 to be always zero. This does not allow a current to flow at feeding point 1 of unbalanced antenna 5A, the ensuring the isolation. Thus, a current does not flow at feeding point 1 of unbalanced antenna 5A, so that the composite antenna device provides a large isolation of unbalanced antenna 5A from balanced antenna 9A.

Figure 8:
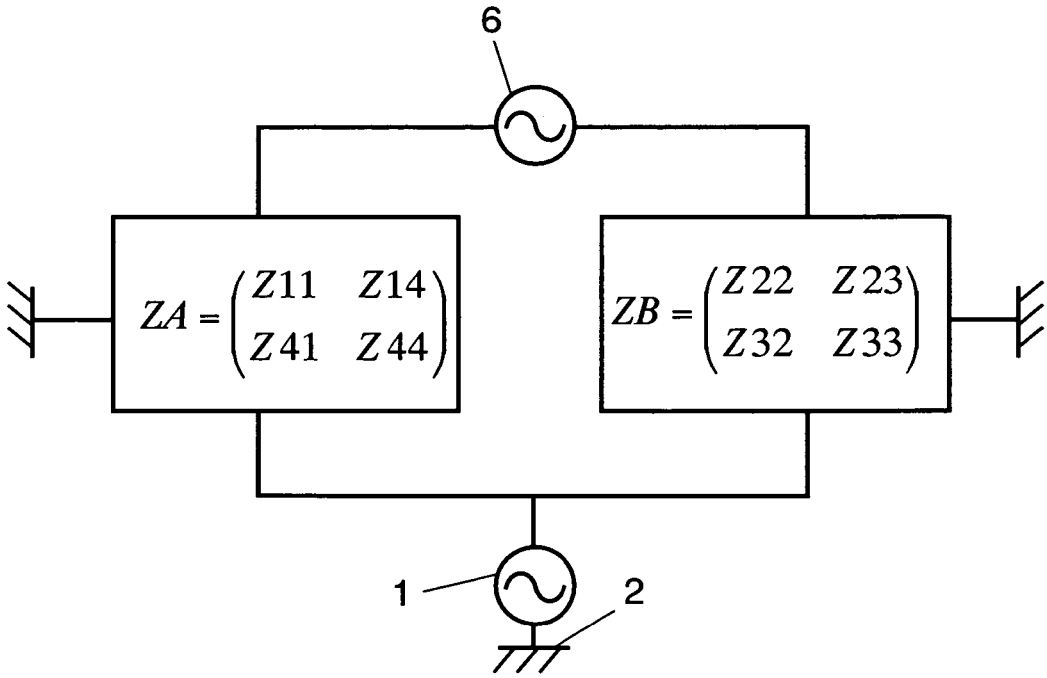
FIG. 8 is another circuit diagram of the composite antenna device according to Embodiment 2.

FIG. 8 is another circuit diagram of composite antenna device 102. According to FIG. 8, the relationship between respective impedances of portion 1504 of load conductor 504 and radiator 8, and the relationship between respective impedances of portion 2504 of load conductor 504 and radiator 507 will be discussed below.

Z14 represents a mutual impedance of radiator 8 to portion 1504 of load conductor 504. Z41 represents a mutual impedance of portion 1504 of load conductor 504 to radiator 8. Z23 represents a mutual impedance of portion 2504 of load conductor 504 to radiator 507. Z32 represents a mutual impedance of radiator 507 to portion 2504 of load conductor 504. Impedance matrixes ZC and ZD are defined as follows:

$$ZC = \begin{pmatrix} Z11 & Z14 \\ Z43 & Z44 \end{pmatrix}$$

$$ZD = \begin{pmatrix} Z22 & Z23 \\ Z32 & Z33 \end{pmatrix}$$

Impedance matrixes ZC and ZD satisfy the relation of ZC=ZD. The relation of ZC=ZD allows a voltage between portion 1504 and portion 2504 of load conductor 504 to be always zero. This situation prevents a current from flowing at feeding point 1 of unbalanced antenna 5A, thus ensuring the isolation. Thus, a current does not flow at feeding point 1 of unbalanced antenna 5A, so that the composite antenna device provides a large isolation of unbalanced antenna 5A from balanced antenna 9A.

Impedance matrixes ZA, ZB, ZC and ZD satisfy not only the relation of ZA=ZB but also the relation of ZC=ZD, thereby causing voltages mutually induced at portion 1504 of load conductor 504 and radiator 8 to be zero, and causing voltages mutually induced at portion 2504 of load conductor 504 and radiator 507 to be zero. This further increases isolation between antennas 5A and 9A.

Exemplary Embodiment 3

Figure 9:
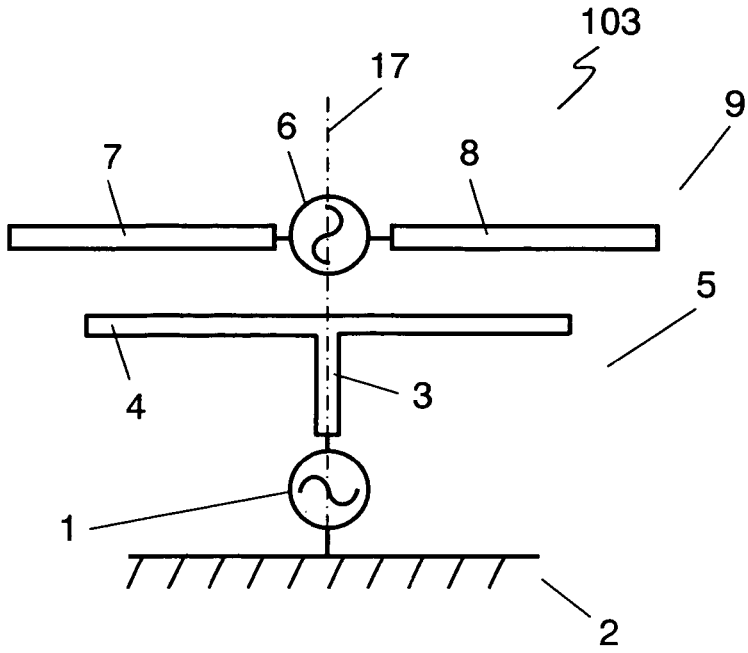
FIG. 9 is a side view of a composite antenna device according to Exemplary Embodiment 3 of the invention.
Figure 10:
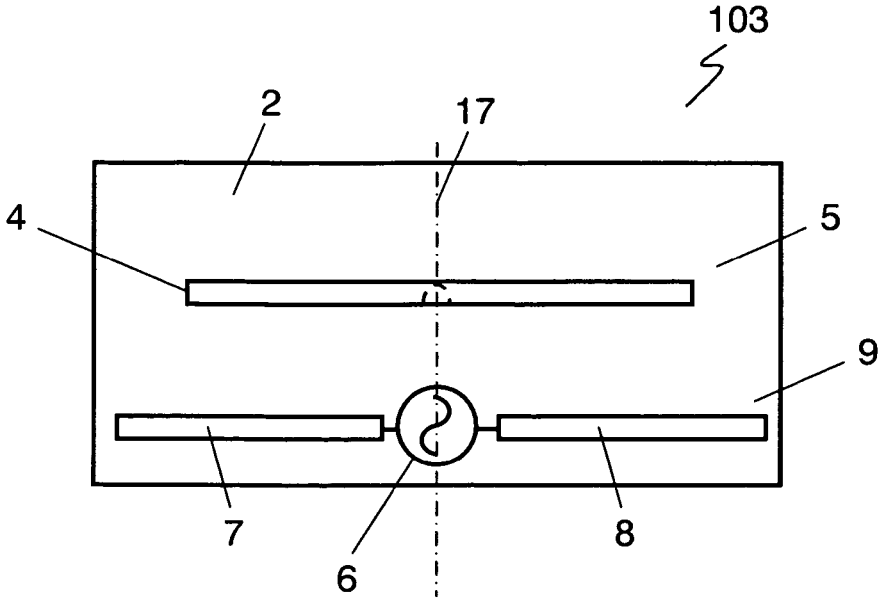
FIG. 10 is a top view of the composite antenna device according to Embodiment 3.

FIGS. 9 and 10 are a side view and a top view of composite antenna device 103 in accordance with Exemplary Embodiment 3 of the present invention, respectively. In FIGS. 9 and 10, elements similar to those of Embodiment 1 are denoted by the same reference numerals, and their descriptions will be omitted.

In composite antenna device 103, differently from composite antenna device 101 shown in FIG. 1 of Embodiment 1, load conductor 4 of unbalanced antenna 5 is symmetrical about plane 17 which passes through feeding point 1 and which is perpendicular to ground board 2. In balanced antenna 9, radiators 7 and 8 are placed at positions symmetrical to each other about plane 17, and have shapes symmetrical to each other.

Composite antenna device 103 having the structure discussed above provides voltages at feeding points 1 and 6 identical to those in composite antenna device 101 of Embodiment 1. As a result, composite antenna device 103 reduces a change in potentials of feeding points 1 and 6 which is caused by mutual interference between antenna 5 and antenna 9. Composite antenna device accordingly provides large isolation between antenna 5 and antenna 9, accordingly having a small size.

The relations of the impedances according to Embodiment 2 do not depend on respective shapes of radiators and load conductors, thus being applicable not only to composite antenna device 101 of Embodiment 1, but also to composite antenna device 103 of Embodiment 3.

INDUSTRIAL APPLICABILITY

A composite antenna device including plural antennas according to the present invention provides large isolation between the antennas, accordingly having a small size.

REFERENCE NUMERALS

1 Feeding Point (First Feeding Point)
2 Ground Board
3 Radiator (First Radiator)
4 Load Conductor
5 Unbalanced Antenna
6 Feeding Point (Second Feeding Point)
7 Radiator (Second Radiator)
8 Radiator (Third Radiator)
9 Balanced Antenna

The invention claimed is:

1. A composite antenna device comprising:

a ground board;

an unbalanced antenna including a first feeding point electrically coupled with the ground board, a first radiator having a first end and a second end, the first end of the first radiator being connected with the first feeding point, and a load conductor having a first end, a second end, and a connection point where the load conductor is connected with the second end of the first radiator, the load conductor intersects a straight line which also passes through the first feeding point and which is perpendicular to the ground board;

a balanced antenna including a second feeding point electrically isolated from the first feeding point, a second radiator connected with the second feeding point, and a third radiator connected with the second feeding point, wherein the load conductor of the unbalanced antenna includes a first portion and a second portion, the first portion of the load conductor being provided between the first end of the load conductor and the connection point, the second portion being provided between the second end of the load conductor and the connection point, and wherein an impedance Z11 of the first portion of the load conductor, a mutual impedance Z12 of the second radiator to the first portion of the load conductor, a mutual impedance Z21 of the first portion of the load conductor to the second radiator, an impedance Z22 of the second radiator, an impedance Z33 of the second portion of the load conductor, a mutual impedance Z34 of the third radiator to the second portion of the load conductor, a mutual impedance Z43 of the second portion of the load conductor to the third radiator, and an impedance Z44 of the third radiator satisfy the relation of $$\begin{pmatrix} Z11 & Z12 \\ Z21 & Z22 \end{pmatrix} = \begin{pmatrix} Z33 & Z34 \\ Z43 & Z44 \end{pmatrix}.$$

2. The composite antenna device of claim 1, wherein a mutual impedance Z14 of the third radiator to the first portion of the load conductor, a mutual impedance Z41 of the first portion of the load conductor to the third radiator, a mutual impedance Z23 of the second portion of the load conductor to the second radiator, and a mutual impedance Z32 of the second radiator to the second portion of the load conductor satisfy the relation of $$\begin{pmatrix} Z11 & Z14 \\ Z43 & Z44 \end{pmatrix} = \begin{pmatrix} Z22 & Z23 \\ Z32 & Z33 \end{pmatrix}.$$

3. A composite antenna device according to claim 1, wherein the unbalanced antenna is between the balanced antenna and the ground board.

* * * * *